United States Patent [19]

Toffolon et al.

[11] 4,251,196

[45] Feb. 17, 1981

[54] APPARATUS FOR PRECASTING CONCRETE PRODUCTS

[75] Inventors: Roger L. Toffolon, Hartford; Warren E. Kart, Bristol, both of Conn.

[73] Assignee: Atlantic Pipe Corporation, Plainville, Conn. ; by said Warren E. Kart

[21] Appl. No.: 31,058

[22] Filed: Apr. 18, 1979

Related U.S. Application Data

[62] Division of Ser. No. 882,929, Mar. 1, 1978, Pat. No. 4,196,161.

[51] Int. Cl.[3] ..... B28B 1/08; B28B 3/08; B28B 7/10

[52] U.S. Cl. ..... 425/173; 249/53 R; 249/102; 249/141; 249/155; 249/160; 425/253; 425/413; 425/421; 425/432; 425/DIG. 117

[58] Field of Search ..... 249/53 R, 102, 141, 249/155, 160; 425/173, 253, 413, 421, 432, DIG. 117; 264/69, 71, 72, 297, 333, 336

[56] References Cited

U.S. PATENT DOCUMENTS

| | | | |
|---|---|---|---|
| 886,877 | 5/1908 | Serrier | 249/135 X |
| 1,884,528 | 10/1932 | Benner et al. | 264/72 |
| 3,273,216 | 9/1966 | Gourlie | 264/71 X |
| 3,492,395 | 1/1970 | Breitfuss | 425/432 X |
| 3,696,182 | 10/1972 | Joelson | 264/72 |
| 3,827,847 | 8/1974 | Weaver | 249/175 X |
| 3,833,331 | 9/1974 | Springs | 264/71 X |
| 3,959,422 | 5/1976 | Wilhelm | 264/71 X |
| 4,132,046 | 1/1979 | Duwe et al. | 264/71 X |

*Primary Examiner*—Jan H. Silbaugh

*Attorney, Agent, or Firm*—McCormick, Paulding & Huber

[57] ABSTRACT

Apparatus for precasting concrete products wherein dry mix is deposited in casting cavities defined by mating upper and base form sections, vibrated and/or pressure compacted, and the upper form section removed immediately for curing of a free standing green cast product. A single upper form section cooperates with a number of base sections and the latter are used to transport the green cast products for curing. Automatically separable base section parts are also employed for the transport of cured products. Forms are adapted for fork lift handling and include high intensity vibrators, sight openings for ascertaining a cavity full condition, closure plates for fill openings, pressure applying and finishing devices, and sectionalized construction for various size products. Casting machine includes mix delivery apparatus and form handling apparatus for upper and base form sections for automated casting and transfer of green cast products for curing.

19 Claims, 27 Drawing Figures

FIG. 16
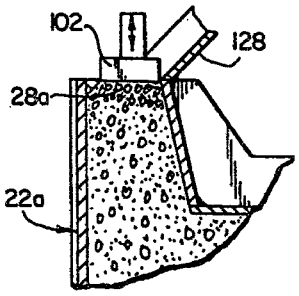
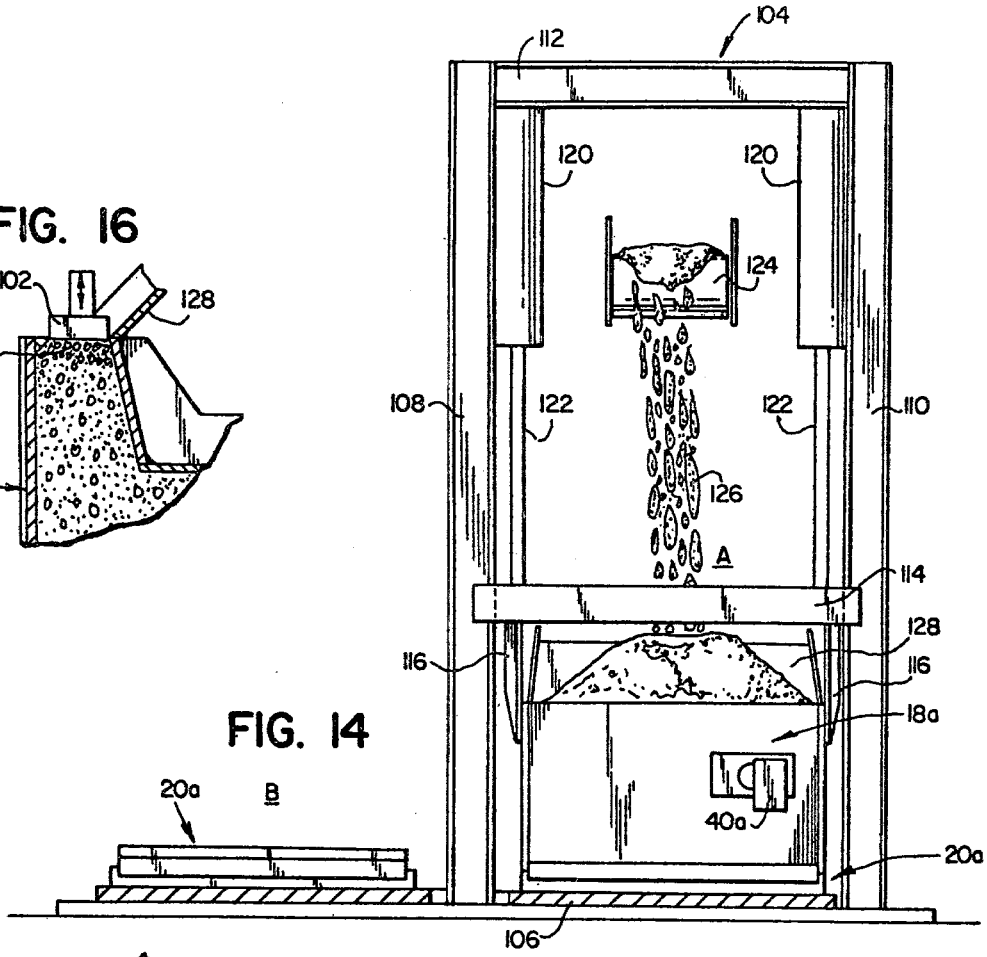
FIG. 14
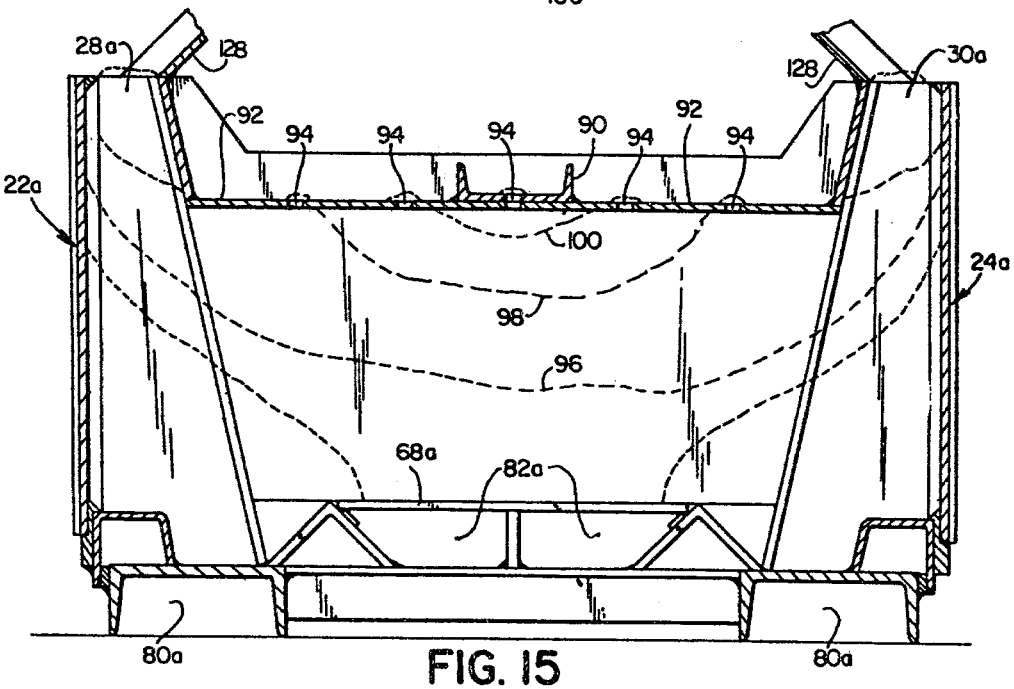
FIG. 15

APPARATUS FOR PRECASTING CONCRETE PRODUCTS

RELATED APPLICATIONS

This application is divided from our corresponding U.S. application Ser. No. 882,929, filed Mar. 1, 1978, now U.S. Pat. No. 4,196,161, entitled: "Method and Apparatus for Precasting Concrete Products".

BACKGROUND OF THE INVENTION

"Dry mix" or "no slump" concrete having a relatively low moisture content has been used in the manufacture of concrete pipe in rotary packerhead machines and the like for some time and satisfactory pipe has been thus produced at comparatively high rates of production. Other types of precast concrete products, however, have been conventionally produced employing a "wet mix" casting process. In a wet mix process, the moisture content of the mix is substantially higher than in a dry mix process, and the conventional practice includes the deposition of mix in forms and the subsequent curing of the cast products with the forms in place. Curing may continue for a period of twelve to sixteen hours to reach approximately one fourth the full strength of the concrete and the forms are then stripped from the cast product and the product subsequently aged for a period of fourteen to twenty eight days to reach full strength. While the wet mix casting process has proven generally satisfactory for low volume production, severe drawbacks are encountered in adapting the process to a high volume production operation. The process is inherently slow and a large number of expensive forms are required.

It is the general object of the present invention to provide apparatus for the precasting of concrete products in a "dry mix" process which process and apparatus are particularly well adapted to high volume and low cost production.

A further object of the invention resides in the provision of apparatus as mentioned wherein dry mix is deposited in a casting cavity and vibrated and/or subjected to external pressure whereby to eliminate voids and to compact the mix and to thereby form a green cast product having sufficient initial structural integrity for self support, the product being thus adapted to immediate curing in a free standing condition with its form removed.

A still further object of the invention resides in the provision of apparatus as set forth wherein separable forms of a specific design are provided permitting the use of a single upper form section with a plurality of base form sections and thus effecting substantial savings in the cost of forms.

A still further object of the invention resides in the provision of apparatus as set forth wherein immediate removal of an upper form section upon completion of casting effects substantial reduction in curing time and thereby enhances high volume and low cost manufacture of concrete products.

A still further object of the invention resides in the provision apparatus as set forth wherein sectional form construction with upper and base sections permits the use of the base sections for the post casting transfer of green cast products and the post curing transfer of cured products.

Still another object of the invention resides in the provision of apparatus as set forth wherein forms are provided with sight openings for visually ascertaining the completion of form filling operations, with closure means for filling and thereafter compacting mix in a casting cavity, and with pressure applying and finishing means for compacting dry mix in the cavity.

Still another object of the invention resides in the provision of apparatus as set forth wherein forms are constructed in separable sections so as to provide various sizes of cast products with major portions of the forms usable throughout a range of product sizes.

SUMMARY OF THE INVENTION

In fulfillment of the foregoing objects and in accordance with the present invention, a form is provided having at least two mating sections comprising an upper section and a base section. The upper section is open downwardly and is provided with a fill opening at the top and the base section closes the upper section at the bottom to cooperatively form a casting cavity. Preferably a plurality of base sections are provided and each base section is adapted for assembly with the upper form section. A dry mix or no slump concrete is deposited in the casting cavity with upper and base form sections assembled and the form is vibrated during and/or after mix deposition to eliminate voids and to compact the mix therewithin so as to form a green cast product having sufficient initial structural integrity for self support. The upper form section is then removed prior to the occurrence of any substantial curing time and may in fact be removed immediately to expose the green cast product and to allow the same to stand free of the base section of the form. The base section of the form is thereafter employed to transfer the green product for curing and, when a two part base form section is employed, one part of the form may be employed for further product transfer subsequent to curing.

The compaction and elimination of voids in the dry mix may also be achieved by the application of external pressure at a region of mix overfill and such operation may occur with or without simultaneous form vibration. Pressure bars may also serve a concurrent pressure application and surface finishing function.

When a plurality of base form sections are employed, the ultimate in savings in the cost of forms and enhanced production rates are achieved. A single upper form section may be employed for successive assembly with the base form sections and after casting and immediate removal of the upper form section, the base sections may be employed successively to transfer green cast products for curing and subsequent storage.

The invention is particularly well suited to the production of precast monolithic concrete units having spaced apart generally parallel walls and at least one interconnecting or cross member. When such units are produced and the forms so configured with fill openings at the tops of wall portions, sight openings may be provided at a top wall of a cross member portion of the form in order to determine the progression of the dry mix into and upwardly to the top of the cross member portion. When the mix appears at and is forced outwardly through a centrally located sight opening, the completion of the fill operation is insured. Further, the invention may involve the provision of forms with cross member portions having a fill opening at the top and an associated closure means, wall portions of the forms also having fill openings at the top. Mix is then deposited in all three fill openings, the cross member fill opening is thereafter closed by the closure means, and vibration and/or the application of pressure effects the necessary compaction and void elimination. Compaction through pressure application may also be achieved with forms having cross member portions permanently closed at the top.

Pressure applying and finishing means of the invention are preferably adapted for movement between operative and inoperative positions respectively for the application of pressure and for a finishing operation and for clearance of the fill openings during deposition of the dry mix into the casting cavity.

Two part base form sections preferably include an automatically separable feature. When the two parts of the base sections are assembled they support green cast products substantially throughout the area of their lower surfaces for transfer from a Casting Station to a Curing Station. This provides substantial support for products which may tend to be somewhat fragile and which must be carefully handled prior to curing. Thereafter, when one part of a base section is engaged separately by a lift means, or the like it automatically separates from the other part of the section to lift a cured product by engaging only a portion of its lower surface. At this point in time, the cured product has attained full strength and the risk of damage or rupture in only partial support of the product is substantially lessened.

Horizontally separable sectionalized forms also provide for the use of parts of the forms in common for the production of similar products over a range of sizes. In particular, the forms configured for the monolithic unit mentioned above may be provided with two or more selectively usable center parts of the cross member portion of the upper form section. Thus, monolithic units having cross members of various length can be produced at a substantial savings in the form cost.

BRIEF DESCRIPTION OF THE DRAWINGS

FIG. 14 is a further somewhat schematic elevational view of the casting machine of FIG. 13 with the upper form section in a lowered position and in assembly with a base form section for casting a concrete product therewithin.

FIG. 15 is an end elevational view of the form of FIGS. 10 and 11 with the sections thereof in assembled condition and with dry mix deposited therein during a casting operation.

FIG. 16 is a fragmentary vertical section through the form of FIG. 15 and showing a manually operable presser and finishing bar.

DESCRIPTION OF PREFFERED EMBODIMENTS

Figure 1:
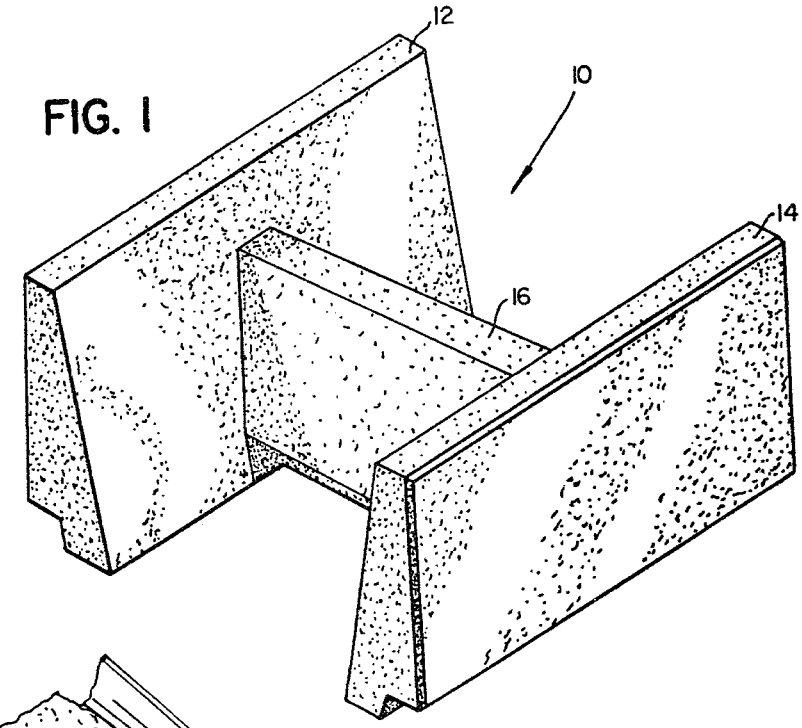
FIG. 1 is a perspective view of a concrete product which may be formed with the apparatus of the present invention, the product taking the form of a monolithic concrete unit comprising spaced apart parallel walls and an integral interconnecting cross member or arm.

The apparatus of the present invention may be employed in the production of a wide variety of precast concrete products. One such product is illustrated in FIG. 1 but, should be regarded as illustrative only. The product shown is a monolithic precast unit indicated generally at 10 and which has spaced apart generally vertical walls 12, 14 in parallel relationship and with an integrally formed interconnecting or cross member 16. A single cross member or arm 16 is illustrated but it will be understood that the unit may require a pair of such arms at opposite ends or at intermediate locations. The particular configuration of the unit derives from the requirements of retaining wall construction and may vary widely. The unit 10 shown is known in the trade as a STA-WAL unit and is further illustrated and described in U.S. Pat. No. 3,877,236, entitled CRIB BLOCK AND STRUCTURE, filed on Oct. 5, 1973 in the names of Raymond J. O'Neill and George David Newell, and issued on Apr. 15, 1975.

In accordance with the invention, precast products such as the unit 10 can be produced in quantity and at low cost employing a dry mix process. The dry mix process utilizes a "dry mix" or "no slump mix" of the type used in the manufacture of concrete pipe in rotary packerhead machines and the like. A dry mix includes cement, aggregate and water in relative proportions substantially different from a conventional wet mix. The moisture content in a conventional wet mix may fall in the range five to ten percent (5% to 10%) whereas the moisture content in a dry mix may fall in the substantially lower range one to four percent (1% to 4%). A wet mix flows readily in reaching remote areas in a form but must be cured for a substantial period of time with the form in place as explained above. A dry mix, on the other hand, does not flow as readily but when properly compacted, the form may be removed prior to the passage of any substantial curing time and in fact immediate form removal is possible. That is, if the dry mix is sufficiently compacted and voids eliminated, the cast product will have sufficient initial structural integrity for self support and will be capable of standing free with its surface exposed for curing immediately on completion of the casting operation. The apparatus of the present invention takes full advantage of the characteristics of a dry mix casting process in effecting substantial reduction in the cost of forms and in providing automated high production rate casting and curing operations.

Figures 3, 4, 5, 6, 7:
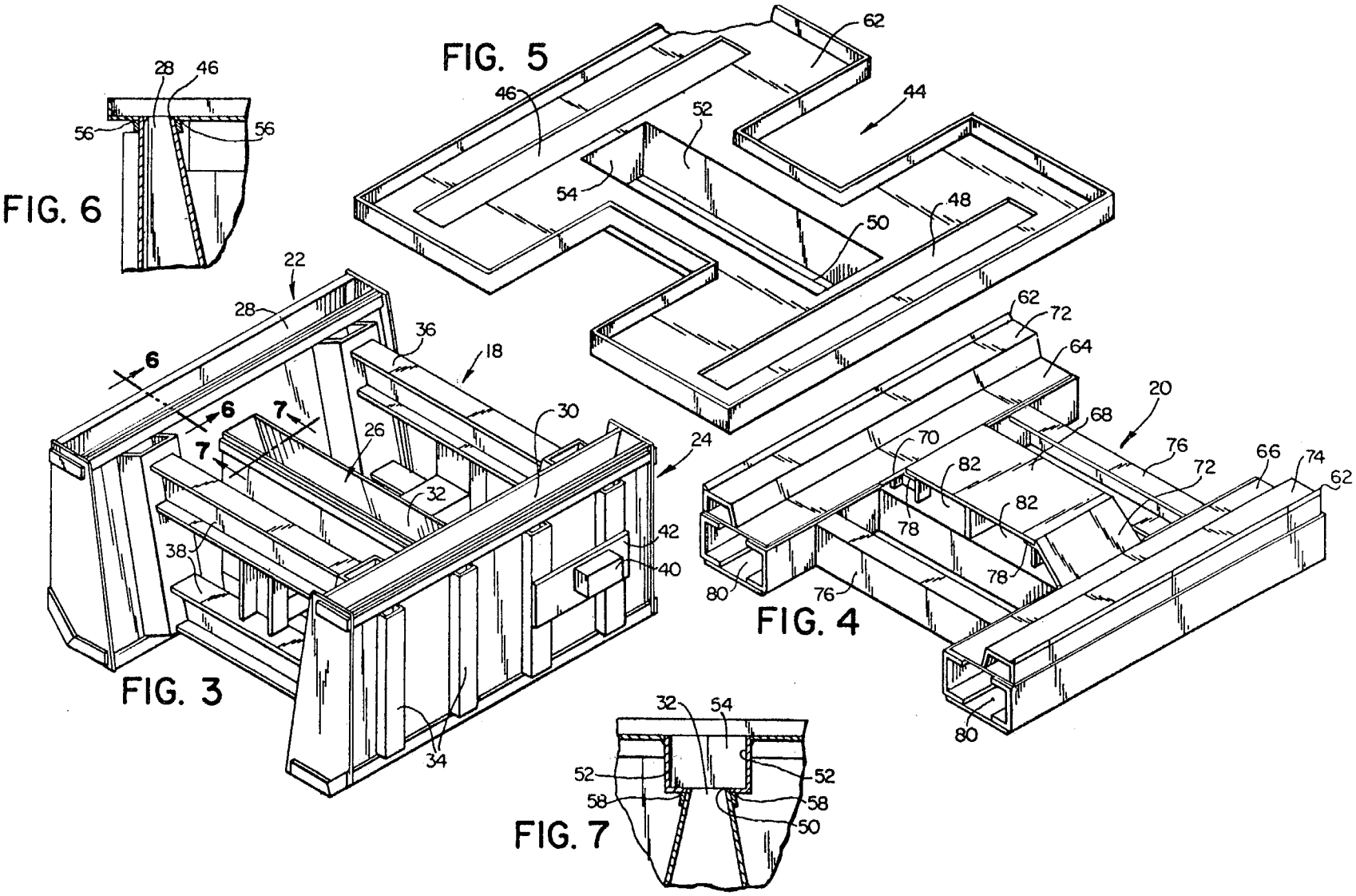
FIG. 3 is a perspective view of an upper section of the form of FIG. 2.
FIG. 4 is a perspective view of a base section of the form of FIG. 2.
FIG. 5 is a perspective view of the mud pan of FIG. 2.
FIG. 6 is a fragmentary sectional view of a portion of the upper form section taken generally as indicated at 6—6 in FIG. 3 and showing a portion of a mud pan in operative association therewith.
FIG. 7 is a fragmentary sectional view of a portion of the form section of FIG. 3 taken generally as indicated at 7—7 in FIG. 3 and showing a portion of a mud pan in operative association therewith.

The apparatus of the invention includes forms illustrated in a first embodiment in FIGS. 2 through 9, the forms being constructed in configurations corresponding to the unit 10 of FIG. 1. It will be apparent, however, that novel features of construction of the forms can be readily adapted to the casting of a wide variety of concrete products. An upper form section indicated generally at 18 is best illustrated in FIG. 3 and a lower or base form section indicated generally by the reference numeral 20 is best illustrated in FIG. 4. In accordance with the presently preferred practice, a single upper form section 18 is provided for cooperation with a plurality of base form sections 20, 20, each of the base sections 20 being adapted to mate with the upper form section 18 and to define a casting cavity in cooperation therewith. The upper form section 18 opens downwardly and is provided with at least one fill opening for the deposition of dry mix in the casting cavity. As illustrated in FIG. 3, the upper form section 18 has spaced parallel and generally vertically extending wall portions 22, 24 and a cross member defining portion 26. Each of said portions is provided with a fill opening at the top and, as shown, wall portion 22 has a fill opening 28 which extends substantially throughout its length and a similar fill opening 30 is provided at the top of the wall portion 24. A fill opening 32 at the top of the cross member portion 26 also extends substantially throughout the length thereof.

The upper form section 18 is of heavy steel construction and may include a plurality of vertical bracing members such as 34, 34 welded on plate steel which defines the wall portions 22, 24. Cross bracing members such as channels 36, 38 may also be provided for rigidity. Precise tolerances in the finished product may thus be assured together with the integrity of the form section during intense vibration of the form and the dry mix deposited therein. A single vibrator 40 is illustrated on the form wall portion 24 and may be permanently mounted or merely engaged with a vibrator supporting plate 42. Preferably, intense vibration is effected at the upper form section 18 and at each of the three portions thereof. That is, a vibrator such as 40 is preferably mounted on the opposite wall portion 22 and a third vibrator is mounted on the connecting or cross member portion 26 of the form, neither shown.

While vibration has been employed in wet mix processes, low intensity snake type vibrators have been conventionally employed. The mix flows readily and vibration merely eliminates "pock marks" and other small defects on the surface of the cast product. Vibration in the present process assists in mix flow when employed during deposition of the mix and compacts the mix when employed during and/or subsequent to deposition of the mix. Preferably, vibration is employed both during and subsequent to mix deposition and with products such as the unit 10 good compaction and void elimination has been attained with vibration continued for a period of one or two minutes after the casting cavity has been filled with mix. High intensity vibration is preferred and good results have been achieved with 8,000 to 12,000 pounds of force at frequencies in the range of 6,000 to 10,000 vibrations per minute.

In FIG. 5, a "mud pan" indicated generally at 44 is employed in association with the upper form section 18. That is, the mud pan 44 is disposed atop the form section 18 to facilitate the deposition of the dry mix into the casting cavity through the fill openings 28, 30, and 32. Corresponding openings 46, 48 and 50 are provided in the mud pan 44 and the opening 50 has depending walls 52, 54 which define the opening 50 adjacent the opening 32, FIG. 7. In FIG. 6, it will be seen that the mud pan opening 46 aligns with the opening 28 in the form wall portion 22 for the downward entry of mix to the casting cavity defined by the form.

Preferably and as illustrated, the mud pan 44 is fixed atop the upper form portion 18 as by welding at 56, 58, FIGS. 6 and 7. With the mud pan so arranged dry mix may be delivered as from chute 60, FIG. 2 which may be movable relative to the mud pan and when the mix is deposited on the flat surface 62 of the mud pan an operator may use a trowel or the like to urge the same toward and into the openings 46, 48 and 50. With vibrators such as the vibrator 40 operating during and/or after the deposition of the dry mix into the casting cavity, the operator may use the trowel to finish the exposed upper surfaces of the walls 12 and 14 and the cross member 16 of the unit 10. Compaction of the mix and void elimination in this embodiment of the invention is accomplished by intense vibration as mentioned and by manual pressure exerted by an operator in his manipulation of a trowel at the fill openings 28, 30 and 32.

Figure 2:
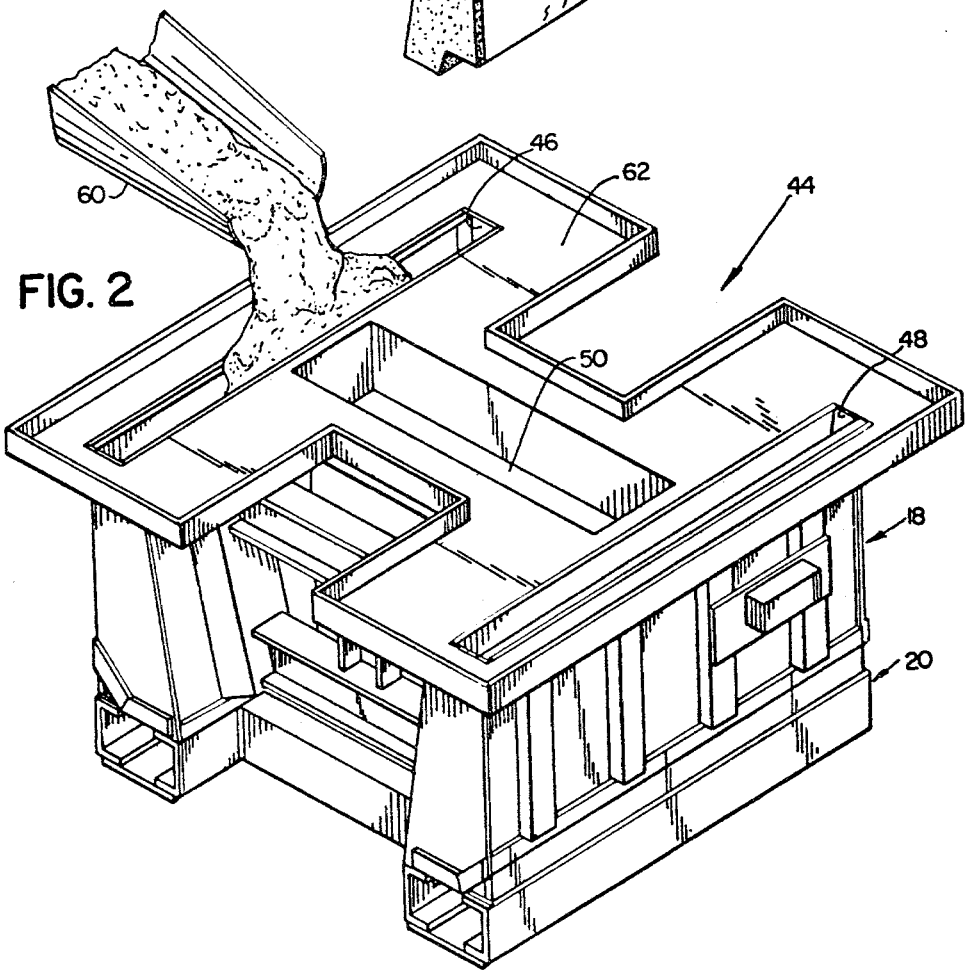
FIG. 2 is a perspective view of a sectional form configured for the unit of FIG. 1, the form comprising upper and base sections in an assembled condition, and a dry mix delivery means in association with the form and including a mud pan atop the form.

The base section 20 of the form shown in FIG. 4 serves to close the bottom of the upper form section 18 when the two form sections are assembled as in FIG. 2. Detachable connecting means may be provided for the two form sections but, as illustrated, the force of gravity is relied upon and the upper form section 18 merely rests on the base form section 20. For proper alignment of the form sections two (2) small inclined alignment bars 62, 62 are preferably provided. When the upper form section 18 is shaped to provide the monolithic cast unit 10 of FIG. 1, the base section 20 is correspondingly shaped and has spaced apart base plates 64, 66 for the lower surfaces of wall portions of the unit 10 and a base plate 68 for the lower surfaces of cross member portion thereof. The plate 68 is somewhat elevated above plate 64, 66 and inclined plates 70, 72 at each end thereof extend to the plates 64, 66 respectively. The base configuration of the unit 10 also has marginally extending stepped-up portions formed by base plates 72, 74 and lateral bracing may be provided as at 76, 76.

As will be apparent, the lower surface of the unit 10 is supported throughout its area by the base section 20 of the form as illustrated in FIG. 4. Thus, during casting the upper form section 18 is completely closed at the bottom by a base section 20 and, subsequent to casting when the green cast unit 10 is capable of supporting itself, the form sections 18, 20 may be separated with the unit 10 left exposed and standing free on the base section 20. A green cast unit 10 is so illustrated in FIG. 8 atop a base form section 20. In this condition, the unit 10 is ready for curing and may be transferred to a curing kiln or the like. A conventional kiln has been employed and a steam cure for a period of 12 to 16 hours has been found to result in cast units 10, 10 reaching their full strength. This of course compares most favorably with a cure of 12 to 16 hours for wet mix casting prior to form stripping and an aging period of 14 to 28 days for the attainment of full strength.

As mentioned, a plurality of base form sections 20, 20 may be provided and by successively mating the base sections with the upper section 18, units 10, 10 may be successively cast and transported for curing in a free standing condition atop the base sections. The casting operation can be accomplished in an extremely short period of time thus accommodating high volume production of the units 10, 10. For example, casting has been accomplished at a daily production rate of 40 to 50 units per 8 hour shift. This is to be compared with wet mix production rates of approximately 8 to 10 units per day with the same labor cost and with 8 to 10 expensive forms in use. Obviously, it is much less expensive to employ a plurality of base form sections 20 and a single upper form section 18 than to provide a plurality of complete or unitary forms as in a wet mix process. Further, a substantial improvement is achieved in quality control. With individual forms for each unit in a wet mix process, variation in form tolerances results in dimensional variations in the cast units. With a single upper form section in the dry mix process identical cast units are produced and retaining walls constructed therefrom have superior characteristics.

As mentioned, the base form sections 20, 20 are preferably provided in two parts with one part adapted to support a unit 10 over only a portion of its lower surface and with the two parts in assembly adapted to support the unit substantially throughout the area of its lower surface. In the assembled condition of FIG. 4 the base form section 20 supports the unit 10 throughout the area of its lower surface, FIG. 8. One part of the base section 20 is, however, separable from the remaining or other part thereof and comprises the plate 68. The plate 68 is supported by two small flanges 78, 78, FIGS. 4 and 9, and is movable vertically relative to the remaining or other part of the base section 20. That is, the plate 68 is held in position in FIG. 4 by gravity but may be lifted from the flanges 78, 78 as illustrated in FIG. 9. When so lifted, the plate 68 supports the unit 10 only throughout a central portion of the lower surface of the cross member 16 but is nevertheless usable for further transfer of the unit. The unit 10 in FIG. 9 is illustrated subsequent to curing and, having reached its full strength, can be readily supported and transported by the plate 68. Thus, when the unit 10 requires full support prior to curing as in FIG. 8, the base section 20 is capable of supplying such support. Subsequent to curing and when there is no danger of structural damage to the unit as might result from partial support, the plate 68 serves efficiently for further transport of the unit. Fast and efficient form stripping is thus provided for and base form sections are available immediately for reuse.

The manner in which base form sections 20, 20 are constructed to provide for the transfer of units 10, 10 thereupon may vary within the scope of the invention. As shown, the base sections 20, 20 are lifted from below and at least one access opening is provided for lifting the assembled base section and a second access opening for lifting its said one part, the lift-off plate 68. As shown, a pair of access openings 80, 80 are provided for lifting the assembled base section 20 and such openings are adapted for the insertion of spaced horizontal fork members 84, 84 of a fork lift device. Similarly, a pair of access openings 82, 82 are provided for lifting the plate 68 and said openings are adapted for the receipt of the fork members 84, 84 of a fork lift device. Obviously, a fork lift truck may be employed as well as an overhead fork lift device. Handling of the green or uncured units 10, 10 should be precise and accomplished with due care when the assembled base sections 20 are lifted with the units thereon. The units are somewhat fragile in their uncured state as mentioned and must be handled accordingly. When the units 10, 10 are transferred or otherwise handled subsequent to curing by lifting the same on the plates 68, 68 the need for extreme care is no longer in evidence. Obviously, the units 10, 10 may be stacked or otherwise stored and the plates 68, 68 returned to their base form sections 20, 20 for reuse of the sections. An excess number of plates 68, 68 may be provided for interchangeable use with the remaining or other parts of the base sections 20, 20.

Figures 10, 11:
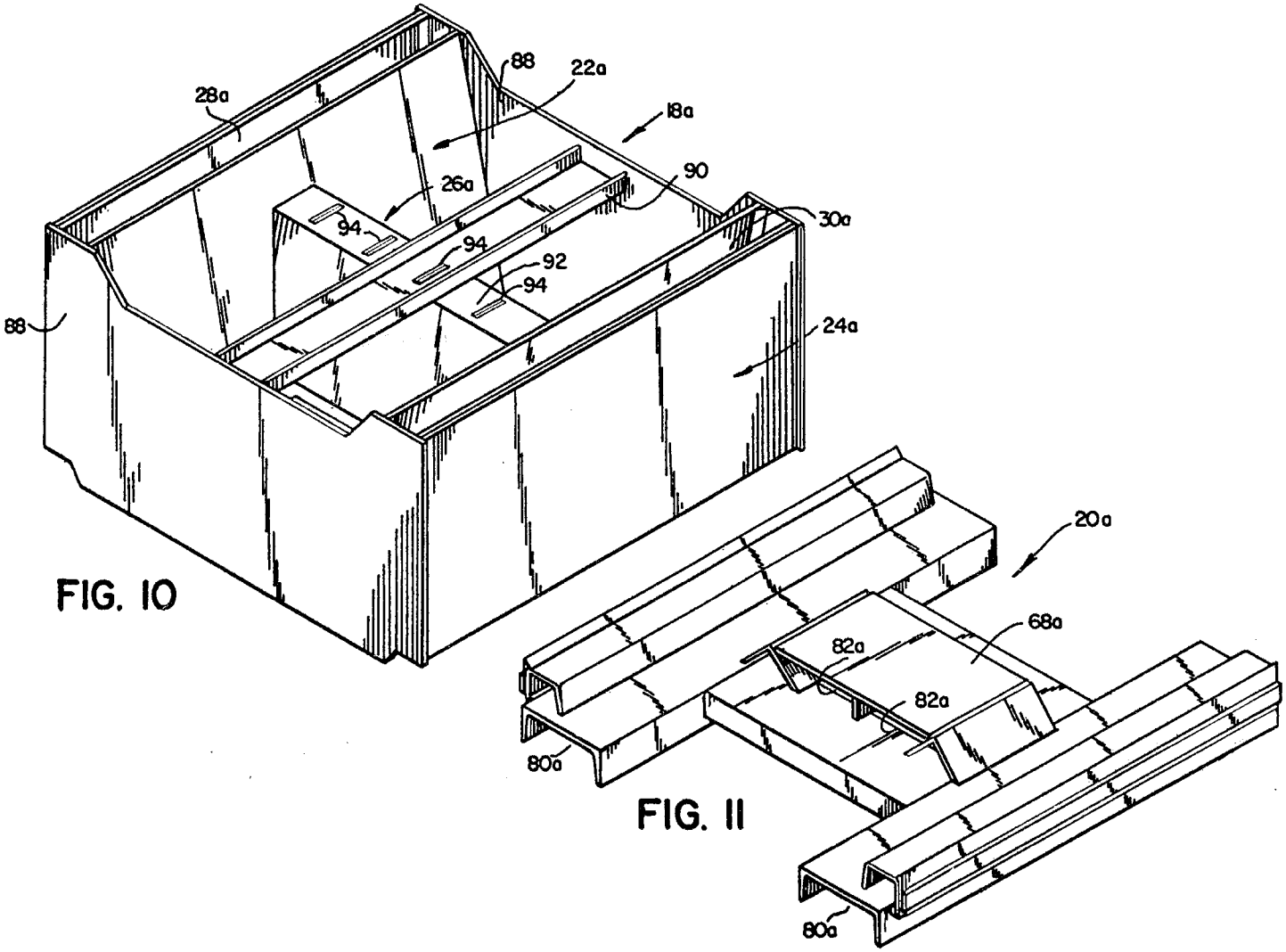
FIG. 10 is a perspective view showing an upper section of a form comprising a second embodiment of the apparatus of the invention.
FIG. 11 is a perspective view showing a base form section adapted to mate with the upper section of FIG. 10.
Figure 12:
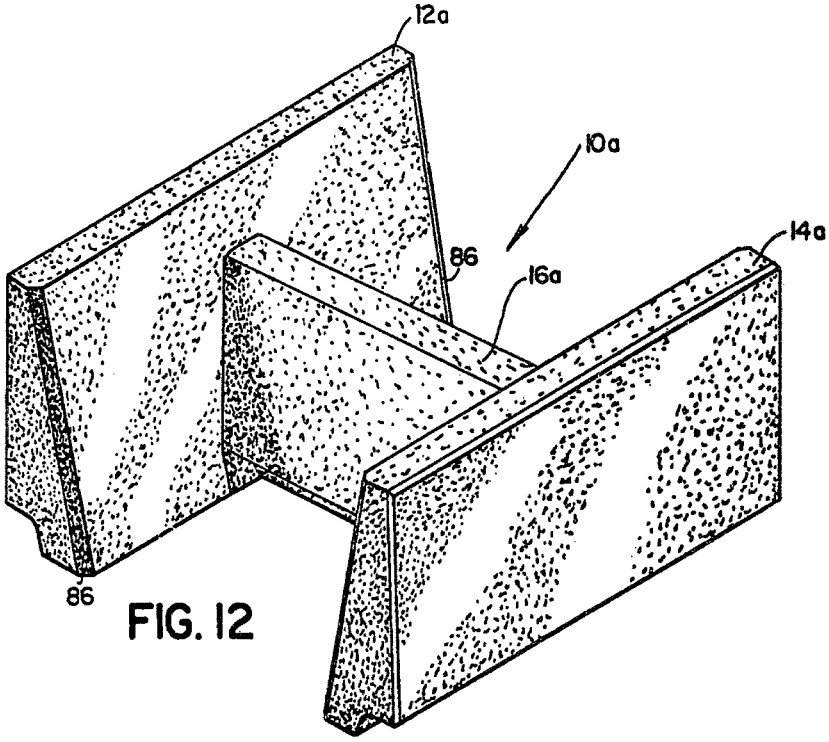
FIG. 12 is a perspective view of a monolithic cast unit derived from the form of FIGS. 10 and 11.

FIGS. 10 and 11 illustrate respectively upper and base form sections **18*a* and 20*a* adapted to produce monolithic cast units 10*a* as shown in FIG. 12. The unit 10*a* is substantially identical with the unit 10 of FIG. 1 but has rounded or beveled edges such as the beveled edges 86, 86 for the elimination of sharp corners and areas of stress. The form sections 18*a*, 20*a* are accordingly substantially identical with the form sections 18, 20 described above but the construction of the sections 18*a*, 20*a* has been substantially simplified. End plates 88, 88 extend between wall portions 22*a*, 24*a* in upper form section 18*a* and a channel 90 extends between the end plates and is secured to the cross member portion 26*a*. Fill openings 28*a* and 30*a* are provided at the top of the wall portions 22*a*, 24*a* but the top of the cross member portion 26*a* is closed by a top wall 92. The top wall 92 has at least one small opening therein in accordance with the invention and, as best illustrated in FIG. 15, a series of five (5) equally spaced openings 94, 94 are provided in the plate. A central opening 94 extends through the plate 92 and the channel 90 so as to be visible from above. The openings 94, 94** are for a purpose to be set forth below.

Figure 8:
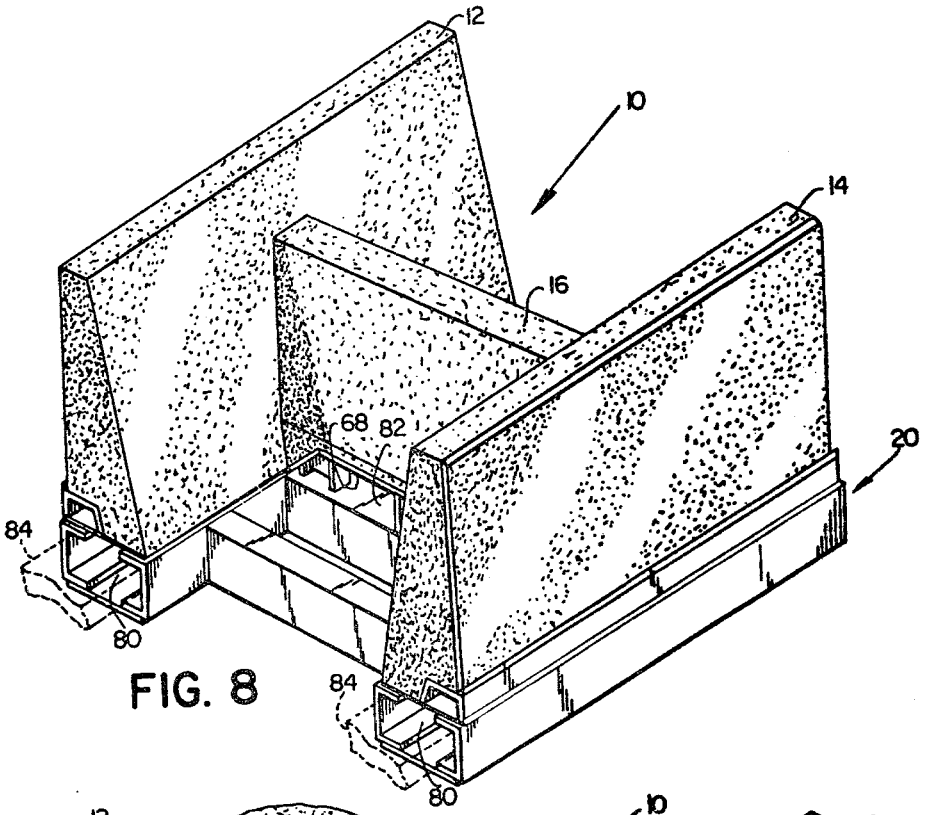
FIG. 8 is a perspective view illustrating a form base section and a green cast unit supported thereon.
Figure 9:
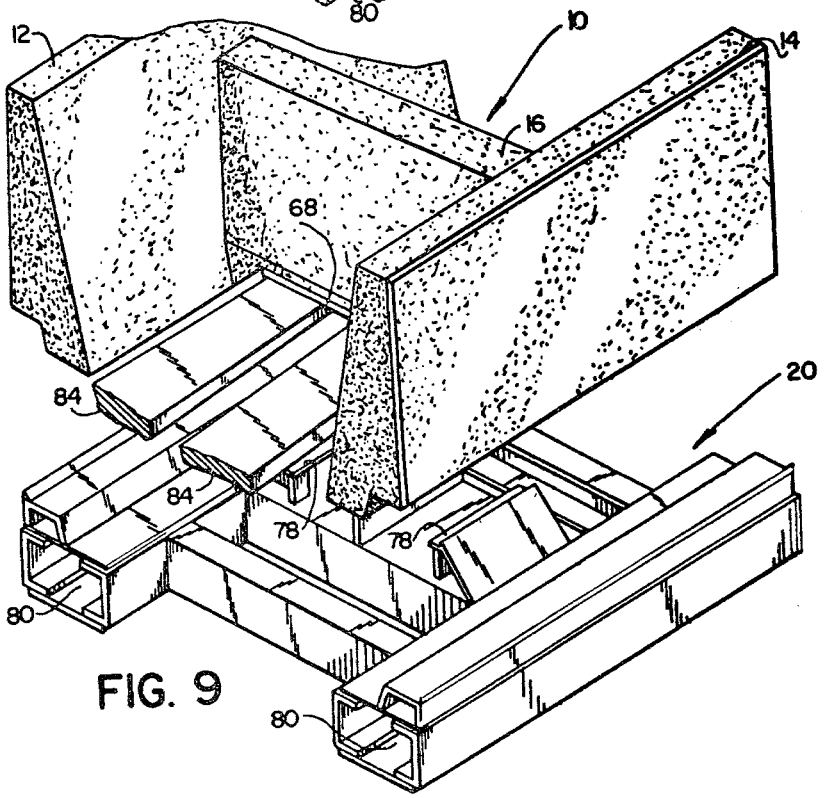
FIG. 9 is an exploded perspective view showing two parts of a form base section and a cured cast unit in an elevated position and supported by one part of the base section.

The base section 20*a* has a vertically movable plate 68*a* and fork lift access openings 80*a*, 80*a* for lifting the assembled base section as in FIG. 8. Fork lift openings 82*a*, 82*a* beneath the plate 68*a* permit lifting of the plate 68*a* with a cured unit 10*a* thereon as in FIG. 9.

The form sections 18*a* and 20*a* are obviously less expensive to manufacture than the form sections 18, 20 illustrated and described above. Further, the casting operation is slightly different with the form sections 18*a*, 20*a*. Rather than filling the cross member 26*a* through a fill opening at the top, the dry mix is deposited only in the fill openings 28*a*, 30*a* and progresses gradually from each of the wall portions 22*a*, 24*a* into and toward the center of the cross member 26*a*, FIG. 15. That is, the dry mix first progresses from each end of the cross member 26*a* toward the center and then gradually rises in the cross member portion 26*a* as indicated by broken lines 96, 98, 100 in FIG. 15. The gradual progression of the mix into and upwardly in the cross member portion 26*a* is caused by intense vibration and/or the application of pressure to the dry mix at the fill openings 28*a*, 30*a*. Thus, vibrators such as 40*a*, FIG. 14, are provided on the form upper section 18*a*, preferably at three locations as mentioned above, and the vibrators may be operated during the deposition of mix and/or subsequent thereto. Pressure may be applied to the mix at the fill openings 28*a*, 30*a* by manual or power operated means and, as illustrated in FIG. 16, an elongated pressure applying and finishing bar 102 may be provided for manual manipulation.

The openings 94, 94 serve as visual indicators to the operator that the mix is progressing as desired into the cross member 26*a* of the form section 18*a*. At a minimum, a single opening 94 may be provided and located approximately centrally in the wall 92 and when mix appears at the opening and is forced upwardly therethrough, the operator is assured that the cross member is completely filled. Alternatively, and as best illustrated in FIG. 15, a series of openings 94, 94 provides visual indication of the progress of the mix upwardly and toward the center of the cross member portion 26*a*. The mix will appear initially at the outermost openings 94, 94, then at the next inwardly spaced openings, and finally at the centrally located opening 94. When the mix has appeared at all of the openings and is forced upwardly therethrough, the operator can be assured that the cross member portion 26*a* is completely filled.

Figure 13:
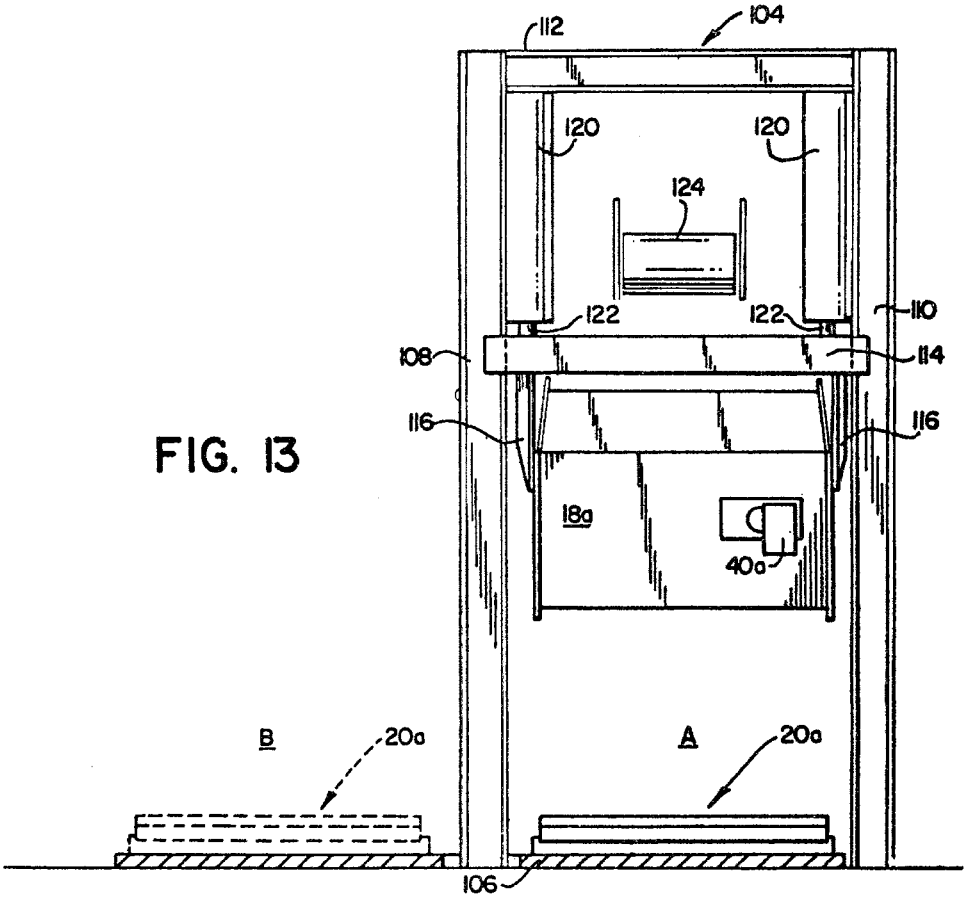
FIG. 13 is a somewhat schematic elevational view of a casting machine for handling the form sections of the preceding figures, an upper form section being shown in an elevated position.
Figure 17:
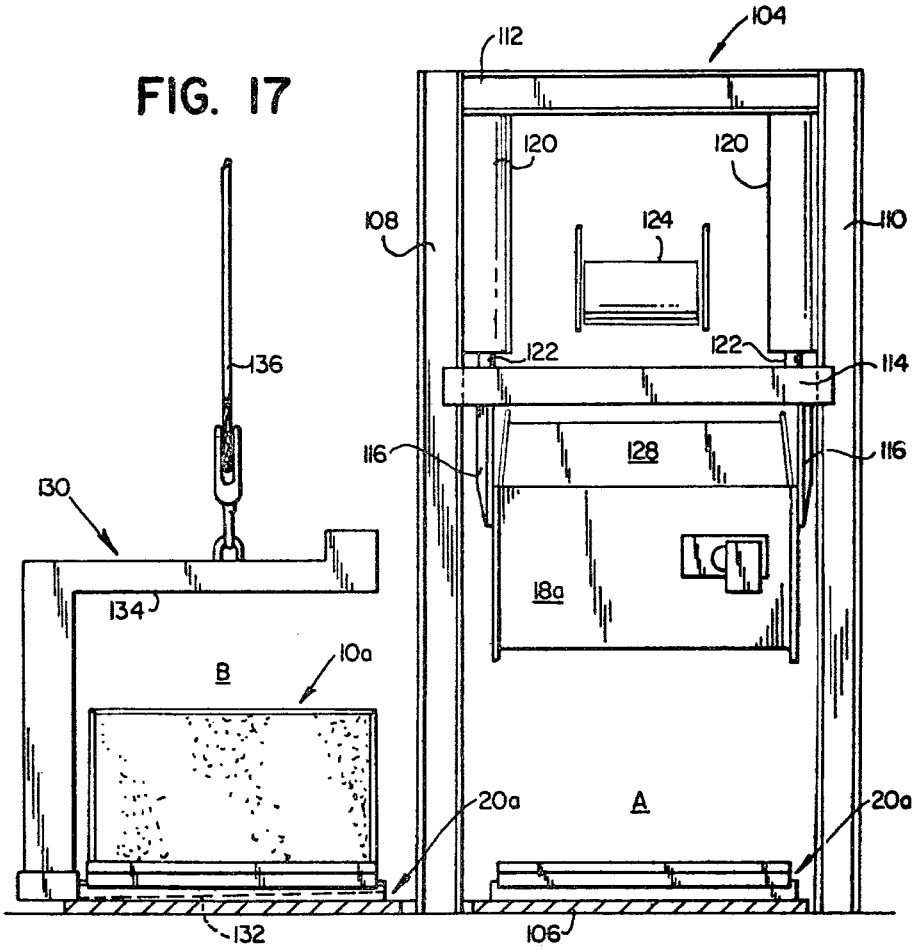
FIG. 17 is a further somewhat schematic elevation of the casting machine showing an upper form section elevated and showing a green cast product on a base form section at a second station in the machine, a lift means for the base form section and the product also being illustrated.

FIGS. 13, 14 and 17 illustrate a casting machine for automating the present invention. The form sections 18*a*, 20*a*, are shown in use in the machine but it will be apparent that the form sections 18, 20 are equally adaptable for such use as well as other types of forms for precast products of various configurations and sizes. The casting machine, indicated generally by the reference number 104, includes a support means for form base sections 20*a* or the like and which is adapted to mount the base sections in an upwardly exposed attitude at a Casting Station A. Preferably, and as illustrated, the support means takes the form of a rotary turntable 106 which may be power driven from below by conventional means and which is movable or indexible through at least two and possibly additional positions. That is, the turntable 106 may be indexed to position a form 20*a* as illustrated at the Casting Station A in FIG. 13, and may then be further indexed to move the base section 20*a* to the broken line position of FIG. 13 at a second or Transfer Station B. In operation, base sections 20*a*, 20*a* may be mounted in succession at the Station A for subsequent casting of products or, alternatively a third station on the turntable 106 may be used for mounting the base sections and they may thereafter be indexed to the Station A. When a product has been cast atop the base section 20*a* at the Station A, the table may thereafter be indexed to the Station B for transfer of the base section 20*a* and a green cast product thereon.

The casting machine comprises a massive frame structure at the Station A which provides for support and rigidity of the various machine elements and which may comprise two or more vertical frame members 108, 110 connected at the top by horizontal frame member 112. An upper form section such as the section 18*a* is arranged at the Casting Station A and relative vertical movement is provided for between the form sections 18*a* and 20*a* for assembly and disassembly respectively for casting and for stripping of the upper form section from a green cast product. As shown, the base form section 20*a* is maintained stationary in the vertical direction and the upper form section 18*a* is movable between upper and lower positions relative thereto.

In FIG. 13, the upper form section 18*a* is shown elevated and supported by vertically movable horizontal frame 114. The frame 114 has depending form support members 116, 116, two shown but four preferred, and which rigidly support the form section 18 against accidental or unintended horizontal displacement. The frame 114 may be guided from the vertical frame members 108, 110 by conventional means such as roller or slide devices so as to move precisely in a desired vertical path and to effect a similar movement of the form section 18*a*. Thus, when the form section 18*a* is elevated subsequent to a casting operation the section is precisely stripped vertically from a green cast unit 10*a* and surface marring or other damage to the unit is avoided.

In moving the frame 114 upwardly and downwardly to effect movement of the form section 18*a* between its upper and lower positions, power operating means are preferably provided in the form of fluid cylinders 120, 120. The fluid cylinders 120, 120 may be mounted on the horizontal cross frame member 112 as shown with their actuating rods 122, 122 operatively connected with the frame member 114. Appropriate valving and other control devices may of course be provided for the regulation of cylinder operation and frame and form section movement.

In operation of the casting machine 104, the upper form section 18*a* is moved downwardly from the position shown in FIG. 13 into assembly with the base section 20*a* as illustrated in FIG. 14. A dry mix delivery means which may take the form of a conveyor 124 thereupon delivers mix 126 to a further delivery means 128 atop the form section 18*a*. The delivery means 128 may take the form of a pair of mix guide and distribution plates arranged in an inverted V so as to direct mix to the fill openings 28*a*, 30*a*, FIG. 15. When the casting cavity has been filled, vibration and/or the application of pressure at the Casting Station A, the dry mix within the form is compacted for initial self support and the upper form section 18*a* may be raised to its upper position as illustrated in FIG. 17 in a stripping operation. The turntable 106 may then be indexed to move the base section 20*a* to the Transfer Station B with the green cast unit 10*a* thereon, and a next succeeding form base section 20*a* may be indexed to the Station A as illustrated.

Figure 18:
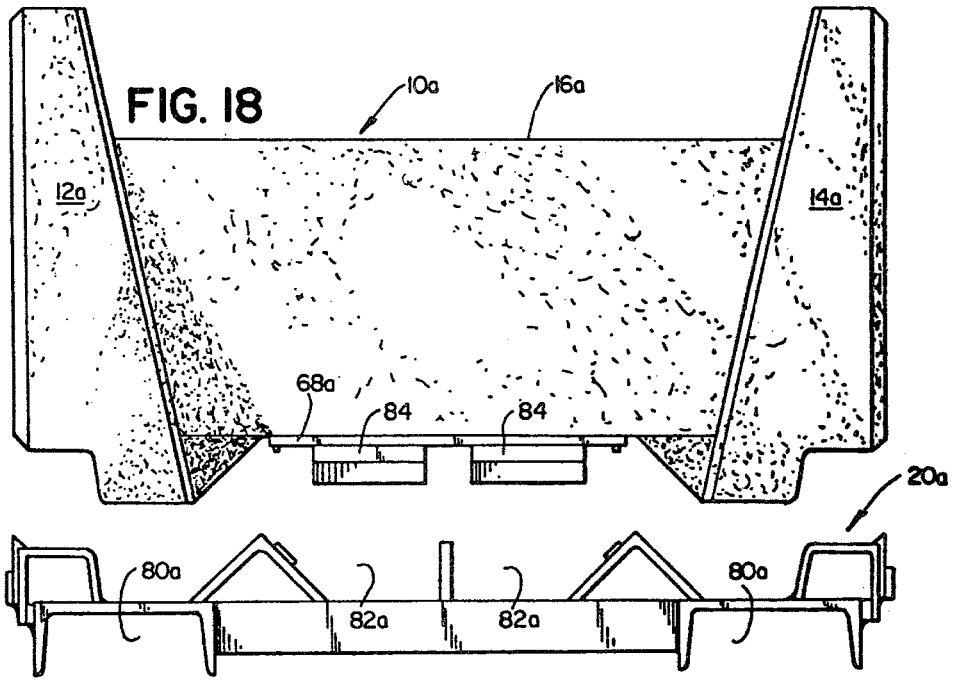
FIG. 18 is an exploded end elevation of the base section of the form of FIGS. 10 and 11 and a cured cast product on one part of the base section.

At the Transfer Station B an overhead fork lift device indicated generally at 130 comprises a pair of fork members 132, one shown in broken line, and an L-shaped frame member 134 supported from a lift device 136. The lift device 136 is movable both vertically and horizontally so as to permit the fork members 132, 132 to enter the access openings 80*a*, 80*a*, FIG. 18, and to lift the base section 20*a* thereby lifting the cast unit thereon. On transfer to a curing kiln and subsequent to curing, the plate 68*a* may be lifted by a fork lift truck to effect further transfer of the finished unit 10*a*, FIG. 18.

Figure 25:
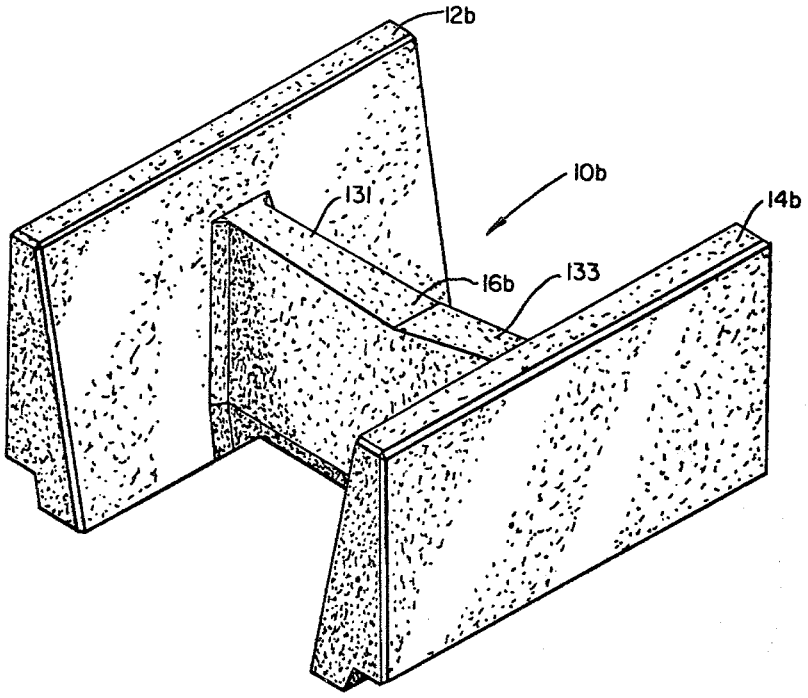
FIG. 25 is a perspective view showing a monolithic cast concrete unit of the type produced with the form of FIGS. 19 et sequa.

Another embodiment of the forms of the present invention is illustrated in FIGS. 19 through 24. Sectionalized upper form sections adapted for horizontal separation and for the use of interchangeable intermediate parts provide for monolithic cast units 10*b* of the type shown in FIG. 25 with varying dimensions of their cross members or arms 16*b*. The unit 10*b* is generally similar to the units shown and described above, but it will be noted that the top of the cross member or arm 16*b* includes oppositely downwardly inclined surfaces 131, 133 meeting at a central line of juncture. The unit 10*b* is the smallest of a series of units having arms 16*b* of varying length. When units 10*b* with longer arms are desired, they are formed with flat central sections as suggested by the assembled form parts of FIGS. 22 through 24.

Figure 20:
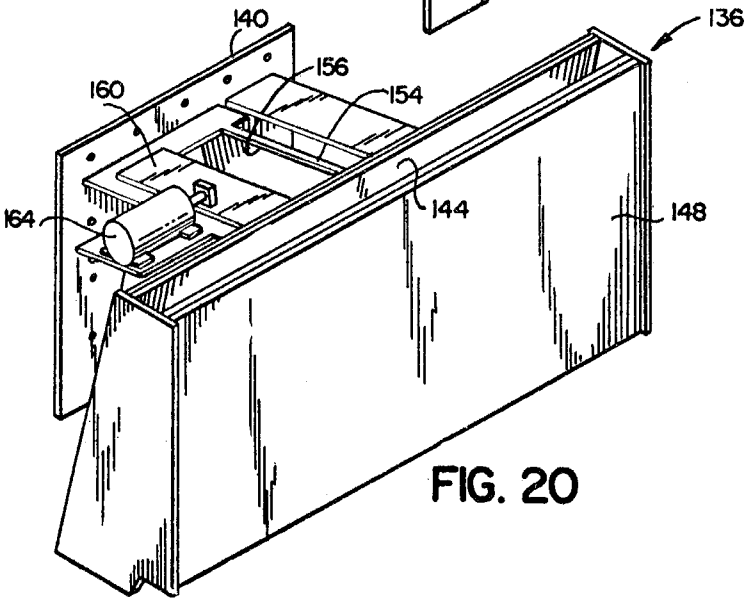
FIG. 20 is a perspective view similar to FIG. 19 but showing a second mating part of the form.
Figure 19:
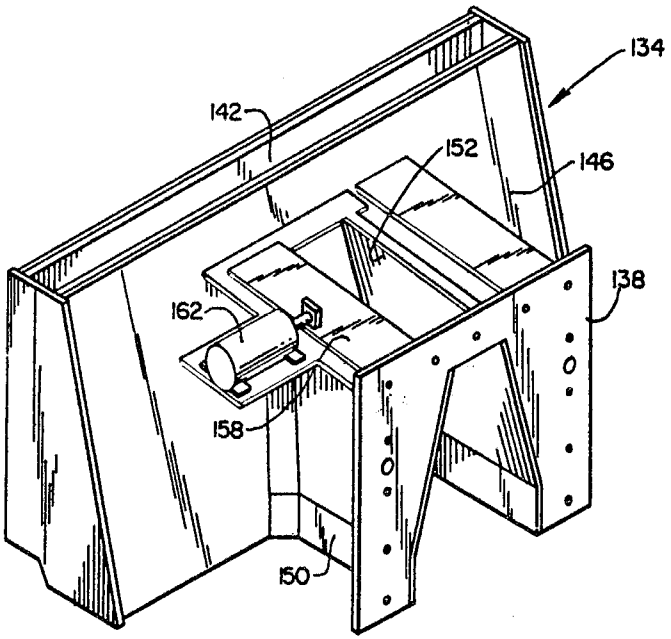
FIG. 19 is a perspective view of an upper section of a horizontally separable sectionalized form and illustrates one mating part of the form.
Figure 22:
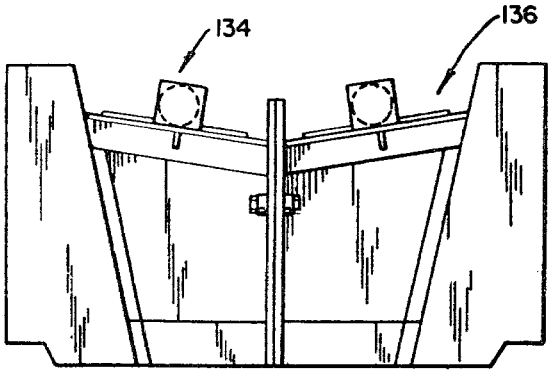
FIG. 22 is an end elevational view showing the parts of the form of FIGS. 19 and 20 in assembled condition.

Mating left and right hand parts 134, 136 of an upper form section are illustrated respectively in FIGS. 19 and 20. Flanges 138, 140 may be bolted or otherwise secured together to provide an assembled upper form section for use in casting the unit 10*b* of FIG. 25. The part 134 has a fill opening 142 and the part 136 has a fill opening 144, the openings being located respectively at the top of wall portions 146 and 148. A left hand part 150 of the cross member portion has a fill opening 152 and a right hand part 154 has a fill opening 156. Associated with the fill openings 152 and 154 are closure members having operative and inoperative positions respectively for closing of the openings and for opening the same for the deposition of dry mix therethrough. The closure means take the form of slidable plates 158, 160 and they are preferably automatically operable respectively by small fluid cylinders 162, 164.

As will be apparent, the form parts 134, 136 may be assembled atop a suitably shaped base form section, not shown, and dry mix deposited through the fill openings 142, 144, 152 and 156. The plates 158, 160 may thereafter be moved to their closed positions and mix compaction accomplished by vibration and/or the application of pressure at the fill openings 142, 144. The form parts are preferably provided with vibrators not shown at each wall portion and at the cross member portion thereof. Pressure applying means may be manual or power operated as will be described hereinbelow.

Figure 21:
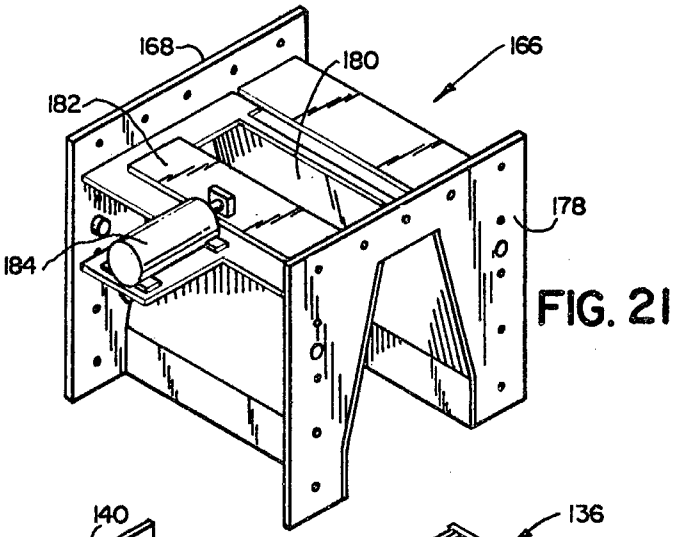
FIG. 21 is a perspective view showing an intermediate part of the upper form section of FIGS. 19 and 20.
Figure 23:
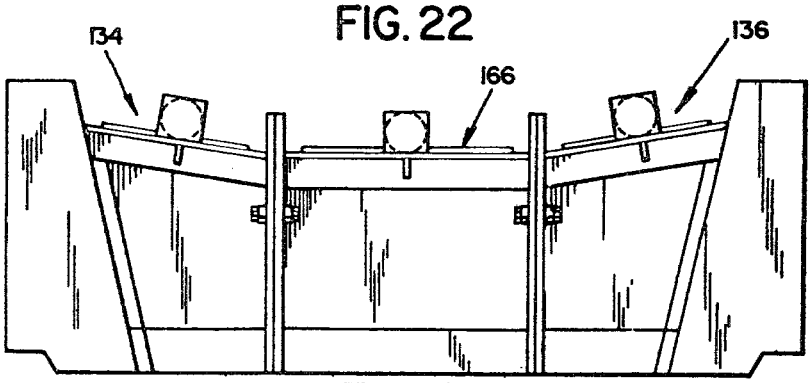
FIG. 23 is an end elevational view showing the form parts of FIGS. 19 and 20 in assembled condition.
Figure 24:
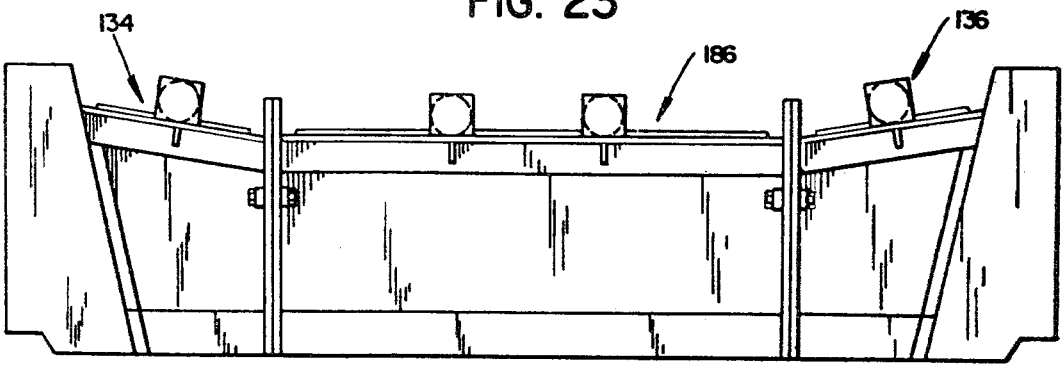
FIG. 24 is an end elevational view showing the form parts of FIGS. 19 and 20 in assembly with an intermediate form part somewhat longer than the form part of FIG. 22.

An intermediate part 166 of the upper form section of FIGS. 19 and 20 is illustrated in FIG. 21. Flanges 168 and 170 are adapted respectively for assembly with the flanges 138 and 140 on the form parts 134, 136. The form part 166 has a fill opening 180 and an associated plate 182 operable by fluid cylinder 184 for opening and closing of the opening. When the form parts 134, 136 and 166 are assembled as illustrated in FIG. 23 and are positioned atop a suitable base section casting may proceed as described above. A further intermediate form part 186 illustrated in FIG. 24 may be similarly employed with the form parts 134, 136 for the casting of a unit 10*b* having a somewhat longer cross member or connecting arm. All operations carried out with the forms described above may be similarly carried out with the sectionalized forms of FIGS. 19 through 24.

Figure 26:
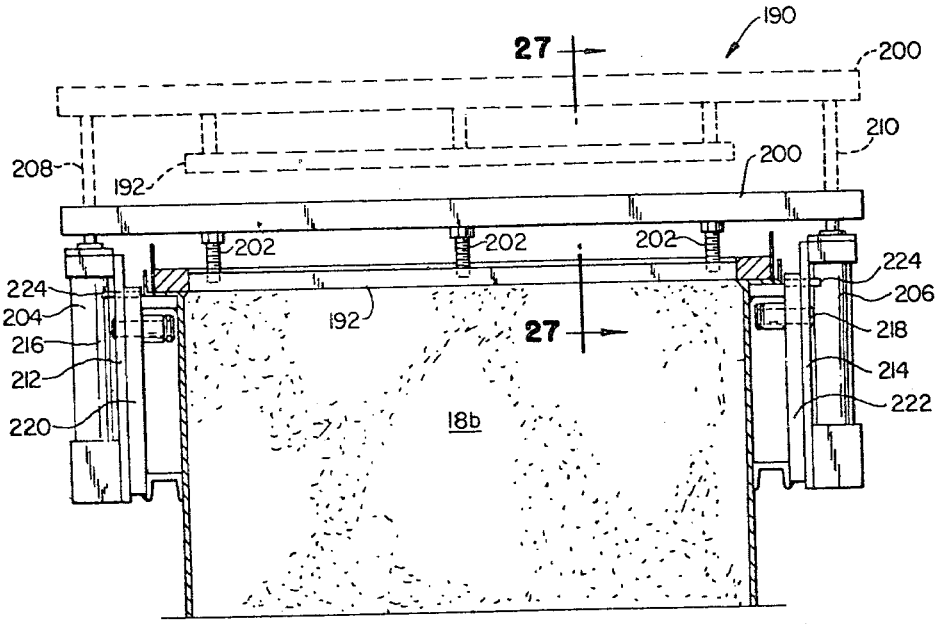
FIG. 26 is a side elevation view of a form provided with a pressure applying and finishing apparatus movable between operative and inoperative positions.
Figure 27:
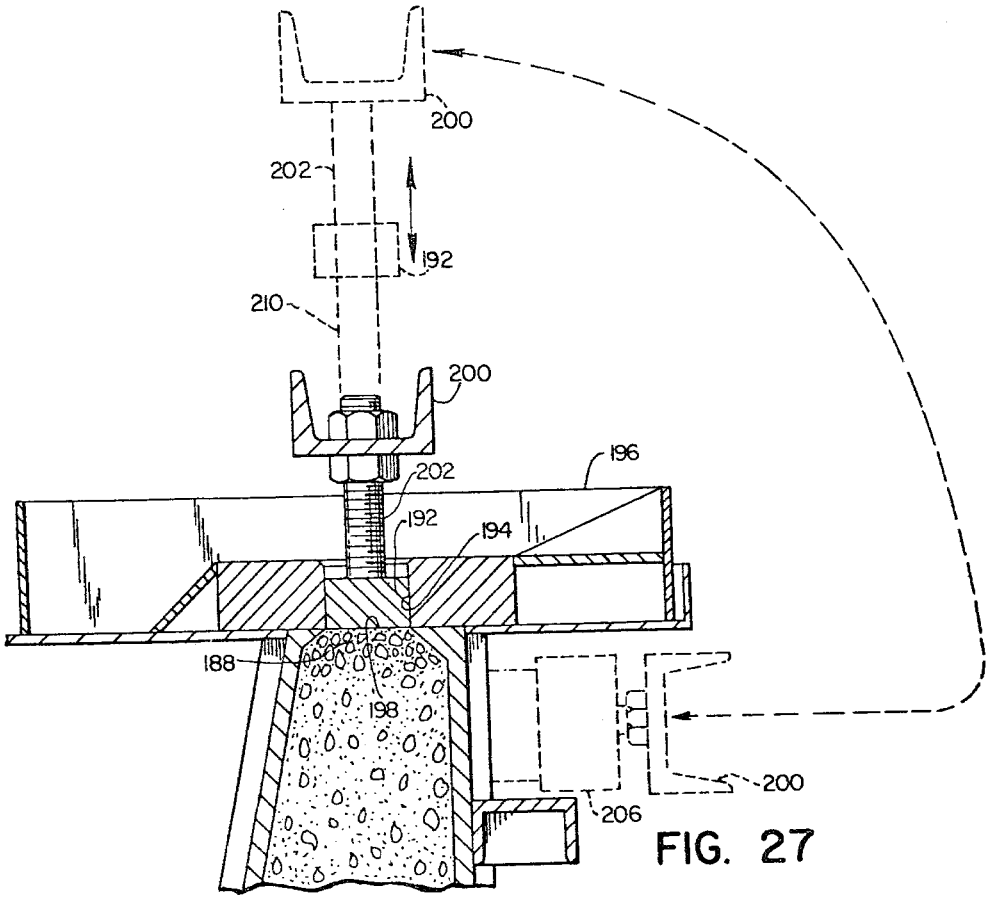
FIG. 27 is a somewhat enlarged fragmentary vertical section taken generally as indicated at 27—27 in FIG. 26, and illustrating the operation of the pressure applying and finishing apparatus.

FIGS. 26 and 27 illustrate an upper form section 18*b* which is provided with a power operated pressure applying and finishing device. The form section 18*b* may be substantially identical with the form sections described above but it should be noted that its cross member portion preferably includes a fill opening with a closure means or, alternatively a permanently closed top wall. Compaction of the dry mix through the application of pressure is best achieved with a casting cavity which is enclosed throughout except for the area of pressure application. Further, it is the preferred practice to combine pressure compaction with vibration compaction and it may be assumed that the form 18*b* is provided with one or more vibratios as described above.

The form section 18*b* has a fill opening along the top and substantially throughout the length of each of its wall portions and one such opening is illustrated at 188 in FIG. 27. Thus, a single power operated pressure applying and finishing device is illustrated generally at 190 but it will be understood that a pair of such devices is required when two (2) fill openings such as 188 are provided.

The device 190 includes a pressure applying and finishing member or bar 192 which is movable vertically in one and an opposite direction and operable to apply pressure to dry mix in an overfill condition at the fill opening 188 in FIG. 27. That is, the bar 192 is movable vertically downwardly toward and into a slot 194 defined in a mud pan 196 mounted atop the upper form section 18*b*. Preferably, a two to three inch overfill condition is provided at the fill opening 188 and the bar 192 is urged downwardly into engagement therewith to compress the overfill and to provide the desired finished surface at 198 at the top of the fill opening. The under surface of the bar 192 may be shaped to finish the surface 198 in any desired configuration and is flat in the form shown in FIG. 27. Substantial compaction of the confined dry mix occurs throughout the mass of the cast unit and a high level of compaction occurs in a localized zone beneath the finished surface 198. The surface 198 also receives a uniform and accurate finish throughout. This is particularly desirable in the case of the monolithic units of the type illustrated at 10, 10*a* and 10*b* since the surface 198 is a bearing surface. Substantial pressure is applied to the mix and excellent results have been achieved with the application of pressure in the range of 50 to 150 pounds per sqaure inch. Good localized compaction beneath the surface 198, good compaction and void elimination throughout the mass of the unit are achieved with the application of pressure in this range and with simultaneous vibration of the form. It should be noted, however, that the invention is not so limited and that the application of compaction pressure may be accomplished with or without simultaneous vibration.

Actuation of the presser and finishing bar 192 is accomplished by a horizontal frame member 200 which supports the bar 192 on three (3) depending rods 202, 202, FIG. 26. The frame member 200 is swingable through an arc as illustrated in FIG. 27 between operative and inoperative positions with the bar 192 elevated from the slot 194 as illustrated in broken line form in FIGS. 26, 27. In its operative position, the frame 200 can be moved vertically downwardly to in turn effect downward movement of the bar 192 and the application of pressure to the overfill in the slot 194. In its inoperative position, the frame 200 swings the bar 192 downwardly and rightwardly in FIG. 27 for clearance during the cavity filling operation.

Preferably and as shown, vertical movement of the frame 200 and bar 192 is effected by means of a pair of fluid cylinders 204, 206 mounted respectively at opposite ends of the form section 18*b*. The cylinders 204, 206 have actuating rods 208, 210 respectively connected with opposite end portions of the frame member 200. Suitable control means for the cylinders effect the required upward and downward movement of the frame 200 and the bar 192.

The cylinders 204, 206 are mounted on pivot plates 212, 214 which have associated pivot pins 216, 218 in turn mounted on plates 220, 222 secured to the form section 18*b*. As will be apparent, the plates 212, 214 may be manually swung about their respective pivot pins to effect swinging movement of the frame member 200 between its operative and inoperative positions. In its upper or operative position, the frame member 200 must be accurately located for precise downward entry of the bar 192 in the slot 194. Accordingly, locking or locating pins 224, 224, one shown, may be provided for entry through suitably aligned openings in the plates 214, 222 and 212, 220.

As will be apparent from the foregoing, apparatus particularly well suited to high volume production has been provided. An important feature of the invention resides in the vibration and/or pressure compaction of dry mix in a casting cavity and the resulting green cast product which has sufficient initial structural integrity for self support. This permits the immediate stripping of an upper form section and the subsequent immediate curring of the green cast product standing free on a base form section. The provision of a plurality of base form sections for cooperation with a single upper form section not only accommodates high production rates but results in substantial savings in the cost of forms. The automation of the process in a power operated casting machine effects further savings in time and the ability to cure the products immediately in an exposed and free standing condition effects a drastic reduction in the time needed to attain full strength of the finished product. In the aggregate, the improvements achieved convert the former slow and tedious wet mix process to a true high volume production operation.

We claim:

1. Apparatus for use in precasting concrete products using a dry mix process wherein green product is capable of standing free and sustaining its own weight and structural integrity almost immediately on completion of formation of the product; said apparatus comprising a downardly open upper form section having the desired configuration of the sides of the product to be cast and at least one fill opening at the top, and a plurality of base form sections each with a configuration corresponding to that of the upper form section and each adapted for detachable assembly with and beneath upper form section to close the bottom thereof and to cooperatively define a downwardly closed casting cavity therewithin, each base form section being further adapted to support a free standing green cast product on disassembly of the form section from the upper form section and on removal of the upper form section from the product, and each base section comprising at least two separable parts which cooperatively and in assembled relationship support the green cast product substantially throughout its lower surface, and one of said parts supporting a cast product throughout only a portion of its lower surface when said parts are separated and in a disassembled relationship, said one part being adapted for transport of the cast product after curing and when it has attained substantially its full strength, and said one part of each base section being supported vertically by the other part thereof and free to move upwardly relative thereto, and access opening being provided beneath each of said parts for selective lifting thereof, said other part serving to raise said one part simultaneously when it is lifted itself.

2. Apparatus for precasting concrete products as set forth in claim 1 wherein each of said base section parts is adapted to be engaged and raised from beneath by a fork lift, said one part being automatically separable from the other part when so raised, and said other part serving automatically to simultaneously lift said one part when raised by a fork lift.

3. Apparatus for precasting concrete products as set forth in claim 1 and including vibration means operatively associated with at least one of said upper and base form sections and operable to provide 8,000 to 12,000 pounds of force at 6,000 to 10,000 vibrations per minute.

4. Apparatus for precasting concrete products as set forth in claim 1 and including pressure applying and finishing means operable to engage dry mix at said fill opening and to finish the engaged surface and compact the mix in the casting cavity.

5. Apparatus for precasting concrete products as set forth in claim 4 wherein said pressure applying and finishing means is mounted on said upper form section and is movable between operative and inoperative portions, said means serving its pressure applying and finishing function in its operative position and providing clearance for a form filling operation in its inoperative position.

6. Apparatus for precasting concrete products as set forth in claim 1 wherein said upper form section has at least two fill openings, and wherein a movable closure means is provided for at least one of said openings, said means having an open condition for a filling operation and a closed condition for a subsequent concrete compaction operation.

7. Apparatus for use in precasting concrete products using a dry mix process wherein green product is capable of standing free and sustaining its own weight and structural integrity almost immediately on completion of formation of the product; said apparatus comprising a downwardly open upper form section having similar spaced apart generally vertically extending parallel wall defining portions and at least one interconnecting cross member defining portion communicating at opposite ends with the wall portions, an upwardly exposed fill opening being provided at the top of each of said wall portions, and a plurality of base form sections each having wall and cross member portions and each adapted for detachable assembly with and beneath said upper form section to close the bottom thereof and to cooperatively define a downwardly closed casting cavity therewithin, each base form section being further adapted to support a free standing green cast product on disassembly of the form section from the upper form section and on removal of the upper form section from the product, and each base section comprising at least two separable parts which cooperatively and in assembled relationship support the green cast product substantially throughout its lower surface, and one of said parts supporting a cast product throughout only the cross member portion of its lower surface when said parts are separated and in a disassembled relationship, said one part being adapted for transport of the cast product after curing and when it has attained substantially its full strength, and the other of said parts being disposed beneath and supporting the wall portions of the cast product.

8. Apparatus for precasting concrete products as set forth in claim 7 wherein each of said base section has its said one part supported from beneath by the other part of said base section.

9. Apparatus for precasting concrete products as set forth in claim 7 wherein said cross member defining portion of said upper form section has a top wall with at least one small opening approximately at its center for visual determination of filling of said form portion.

10. Apparatus for precasting concrete products as set forth in claim 9 wherein each form is provided with a series of small openings along the top wall of its cross member portion.

11. Apparatus for precasting concrete products as set forth in claim 7 wherein an upwardly exposed fill opening is provided at the top of said cross member portion of said upper form section, and wherein a movable closure means is provided for said fill opening.

12. Apparatus for precasting concrete products as set forth in claim 11 wherein said closure means is of the sliding type and is provided with an operating means in the form of a fluid operable cylinder mounted on said upper form section.

13. Apparatus for precasting concrete products as set forth in claim 7 wherein each of said fill openings at the top of said wall portions of said upper form section extend substantially throughout the length of the wall protions, and wherein a pressure applying and finishing means is operable to engage dry mix at said fill opening and to finish the engaged surface and compact the mix in the casting cavity.

14. Apparatus for precasting concrete products as set forth in claim 13 wherein said pressure applying and finishing means includes a pair of elongated finishing bars associated respectively with said wall portion fill openings and each having associated power operating means for causing said bars to exert pressure in the range 50 to 150 pounds per square inch.

15. Apparatus for precasting concrete products as set forth in claim 14 wherein each of said finishing bars has an associated supporting frame swingably mounted on said upper form section for movement between said operative and inoperative positions, and wherein said power operating means take the form of fluid cylinders operatively associated with said supporting frames for urging the finishing bars downwardly in said fill openings for pressure application.

16. Apparatus for precasting concrete products as set forth in claim 7 wherein said interconnecting cross member portion of upper form section is constructed in at least two vertically divided detachable parts, wherein at least one intermediate cross member part is provided for assembly between said two detachable parts whereby selectively to provide cast products having interconnecting cross members of at least two different lengths.

17. Apparatus for precasting concrete products as set forth in claim 16 wherein a plurality of intermediate cross member parts of different lengths are provided, cast products having cross members of several different lengths being thus selectively provided.

18. Apparatus for precasting concrete products as set forth in claim 16 wherein such said cross member parts is provided with a fill opening at the top, and wherein each of said parts has a movable closure member associated with its fill opening.

19. Apparatus for precasting concrete products as set forth in claim 18 wherein at least two vibrators are provided and mounted respectively on said wall protions of said upper form section.

* * * * *